US012075857B2

(12) United States Patent
Li

(10) Patent No.: US 12,075,857 B2
(45) Date of Patent: Sep. 3, 2024

(54) CYCLING PAD, CYCLING PANTS, AND MANUFACTURING METHOD OF CYCLING PANTS

(71) Applicant: JELENEW INCORPORATED, Wilmington, DE (US)

(72) Inventor: Lin Li, Wilmington, DE (US)

(73) Assignee: JELENEW INCORPORATED, Wilmington, DE (US)

( * ) Notice: Subject to any disclaimer, the term of this patent is extended or adjusted under 35 U.S.C. 154(b) by 152 days.

(21) Appl. No.: 17/887,496

(22) Filed: Aug. 14, 2022

(65) Prior Publication Data

US 2024/0049809 A1 Feb. 15, 2024

(51) Int. Cl.
*A41D 1/084* (2018.01)
*A41D 13/015* (2006.01)

(52) U.S. Cl.
CPC ..... *A41D 1/084* (2013.01); *A41D 13/015* (2013.01)

(58) Field of Classification Search
CPC ..... A41D 1/084; A41D 13/015
USPC ..... 2/267, 238, 467
See application file for complete search history.

(56) References Cited

U.S. PATENT DOCUMENTS

| | | | | |
|---|---|---|---|---|
| 5,271,101 | A * | 12/1993 | Speth | A41D 1/084 2/214 |
| 7,757,311 | B2 * | 7/2010 | Garneau | A41D 1/084 2/466 |
| 9,526,276 | B2 * | 12/2016 | Lambertz | A41D 1/084 |
| 9,526,277 | B2 * | 12/2016 | Garneau | A41D 13/0537 |
| 2017/0135420 | A1 * | 5/2017 | Peng | A41D 1/084 |
| 2023/0292852 | A1 * | 9/2023 | Kennison | A41D 1/084 2/466 |

FOREIGN PATENT DOCUMENTS

WO WO-2023084042 A1 * 5/2023

* cited by examiner

*Primary Examiner* — Tajash D Patel

(57) ABSTRACT

A cycling pad includes a base, a first bulge, two second bulges, and two third bulges. The base includes a first end portion and a second end portion arranged opposite to the first end portion. A size of the first end portion is less than a size of the second end portion. The first bulge is arranged on the first end portion of the base. The second bulges are arranged on the base and are arranged side by side. The second bulges are arranged adjacent to one side, facing the second end portion of the base, of the first bulge. The third bulges are arranged side by side on the base. The third bulges are arranged adjacent to one side, facing the second end portion of the base, of the second bulges.

15 Claims, 7 Drawing Sheets

CYCLING PAD, CYCLING PANTS, AND MANUFACTURING METHOD OF CYCLING PANTS

TECHNICAL FIELD

The present disclosure relates to a field of wearable clothing, and in particular to a cycling pad, cycling pants, and a manufacturing method of the cycling pants.

BACKGROUND

Many cycling enthusiasts prefer to wear cycling pants having a built-in pad. Health and comfort, brought by the cycling pants, to users are closely related to cycling pads. The cycling pads were originally developed in 1900 and manufacturers developed the cycling pads by sewing a suede pad into a crotch bottom of sheepskin shorts for protecting genital soft tissues of male riders from being worn during cycling. With the progress and development of society, non-suede built-in pads were developed to have padding inside and further provide with a cushioning function. Almost all cycling pants for females on the market are developed new products by following an original thought of considering a male physiological structure, a main practice of which is to arrange the cycling pads on a crotch portion of the cycling pants, and a bottom of the crotch portion of the cycling pants is in a form of a triangular crotch or a continuous piece made by direct cutting. Due to great differences in physiological structures between males and the females, it is uncomfortable for the females to wear such cycling pads or cycling pants.

SUMMARY

Embodiments of the present disclosure provide a cycling pad, cycling pants, and a manufacturing method of the cycling pants, which adapt to a physiological structure of women and are comfortable for the women to wear.

The embodiments of the present disclosure provide a cycling pad. The cycling pad comprises a base, a first bulge, two second bulges, and two third bulges.

The base comprises a first end portion and a second end portion arranged opposite to the first end portion. A size of the first end portion is less than a size of the second end portion. The first bulge is arranged on the base and is arranged on the first end portion of the base. The two second bulges are arranged on the base and are arranged side by side. The two second bulges are arranged adjacent to one side, facing the second end portion of the base, of the first bulge. The two third bulges are arranged on the base and are arranged side by side. The two third bulges are arranged adjacent to one side, facing the second end portion of the base, of the second bulges.

In some optional embodiments, the two second bulges are arranged at intervals. A first groove is formed between the two second bulges.

The two third bulges are arranged at intervals. A second groove is formed between the two third bulges.

The second groove is communicated with the first groove. The first bulge faces the first groove.

In some optional embodiments, the first bulge, each of the second bulges, and each of the third bulges are of a gentle slope structure.

In some optional embodiments, the cycling pad further comprises a buffer layer and a fabric layer, the buffer layer is arranged between the base and the fabric layer. The buffer layer comprises a plurality of buffer blocks forming the first bulge, the two second bulges, and the two third bulges.

In some optional embodiments, the buffer layer further comprises a buffer piece. The buffer piece is laid flat on the base. The plurality of the buffer blocks is fixedly arranged on the buffer piece.

In some optional embodiments, the base comprises two side edges connecting the first end portion and the second end portion of the base. The two side edges of the base are arranged opposite to each other. Each of the two side edges comprises a first portion and a second portion connected to the first portion. The first portion of each of the two side edges of the base is connected to the first end portion of the base. The second portion of each of the two side edges of the base is connected to the second end portion of the base. The first portion of each of the two side edges of the base is a recessed curved surface. The second portion of each of the two side edges of the base is a flat surface.

In some optional embodiments, the cycling pad further comprises two side pads. The two side pads are arranged on two sides of the base. Each of the two side pads is connected to the first portion of each of the two side edges of the base.

The embodiments of the present disclosure further provide cycling pants. The cycling pants comprise a pants body and the cycling pad mentioned above. The cycling pad is mounted on the pants body.

In some optional embodiments, an edge of the cycling pad is fixedly connected to the pants body, and a middle portion, facing away from the pants body, of the cycling pad defines a bulge.

In some optional embodiments, the bulge extends from the first end portion to the second end portion of the cycling pad.

The embodiments of the present disclosure further provide a manufacturing method of cycling pants. The manufacturing method comprises steps:

- obtaining a base, where the base comprises a first end portion and a second end portion arranged opposite to the first end portion; a size of the first end portion is less than a size of the second end portion;
- arranging a first bulge, two second bulges, and two third bulge on the base, where the first bulge is arranged on the first end portion of the base, the two second bulges are arranged side by side and are arranged adjacent to one side, facing the second end portion of the base, of the first bulge, and the two third bulges are arranged side by side and are arranged adjacent to one side, facing the second end portion of the base, of the second bulges; and
- mounting the cycling pad on the pants body.

In some optional embodiments, a step of mounting the cycling pad on the pants body comprises:

- obtaining the cycling pad, and bulging a middle portion of the cycling pad; and
- fixing an edge of the cycling pad on the pants body.

In some optional embodiments, a step of bulging the middle portion of the cycling pad comprises:

- folding the cycling pad in half along a center line of the cycling pad;
- sewing a first auxiliary thread on the cycling pad that is half-folded with respect to the center line to fix overlapping sides of the cycling pad together;
- obtaining a pants body, and aligning the cycling pad with the pants body;
- unfolding the cycling pad that is half-folded so that the middle portion of the cycling pad sewn by the first auxiliary thread is raised to define a bulge;

fixing an edge of the cycling pad, having the bulge raised on the middle portion of the cycling pad, on the pants body; and removing the first auxiliary thread of the cycling pad.

The first auxiliary thread is a curved thread extending from a front end to a rear end of the cycling pad.

In some optional embodiments, the first auxiliary thread is curved away from the center line at the front portion and the rear portion of the cycling pad. The first auxiliary thread is curved toward the center line in the middle portion of the cycling pad.

In some optional embodiments, in a step of sewing the first auxiliary thread on the cycling pad that is half-folded with respect to the center line to fix the overlapping sides of the cycling pad together, the first auxiliary thread is not knotted.

A step of removing the first auxiliary thread of the cycling pad comprises holding one end of the first auxiliary thread and withdrawing the first auxiliary thread to remove the first auxiliary thread.

In some optional embodiments, after unfolding the cycling pad that is half-folded, the manufacturing method further comprises a step of sewing a second auxiliary thread at a position of the pants body corresponding to the center line of the cycling pad.

After removing the first auxiliary thread of the cycling pad, the manufacturing method further comprises a step of removing the second auxiliary thread of the pants body.

In some optional embodiments, in a step of sewing the second auxiliary thread at the position of the pants body corresponding to the center line of the cycling pad, the second auxiliary thread is not knotted.

A step of removing the second auxiliary thread of the pants body comprises holding one end of the second auxiliary thread and withdrawing the second auxiliary thread to remove the second auxiliary thread.

In the embodiments of the present disclosure, the first bulge, the two second bulges, and the two third bulges are arranged on the base of the cycling pad. The first bulge is arranged on the first end portion of the base. The size of the first end portion is less than the size of the second end portion of the base. The two second bulges are arranged side by side and are arranged adjacent to one side of the first bulge away from the first end portion of the base. The two third bulges are arranged side by side and are arranged adjacent to one side of the second bulges away from the first end portion of the base. The five bulges are distributed in a five-point pattern, which mitigates stress on stress-bearing portions of buttocks of a female user such as perineum, pubis, and ischium, protects main stress-bearing portions of the female user, and makes the main stress-bearing portions of the buttocks of the female user evenly stressed. The cycling pad is in line with a physiological structure of females and fits a body of the female user. During riding, the bulges with the five-point pattern provide a sufficient cushioning effect for the main stress-bearing portions of the buttocks of the female user, which is comfortable for the female user to use.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

For a complete understanding of the present disclosure, the following description will be made with reference to the accompanying drawings. The same reference numerals refer to the same parts in the following description.

In the drawings.

Figure 1:
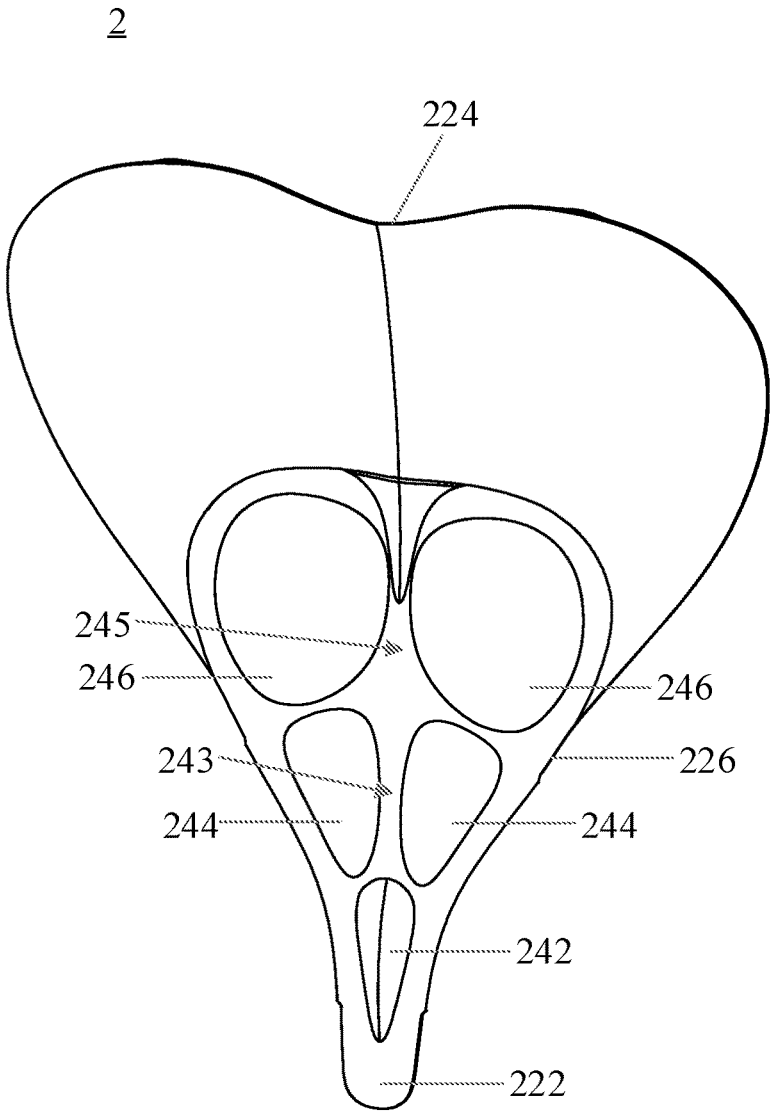
FIG. 1 is a schematic diagram of a first embodiment of a cycling pad of the present disclosure.

cycling pants 1; cycling pad 2; first auxiliary thread 21; base 22; first end portion 222; second end portion 224; side edge 226; first portion 2262; second portion 2264; buffer layer 24; buffer piece 241; first bulge 242; first groove 243; second bulge 244; second groove 245; third bulge 246; fabric layer 26; side cushion 28; pants body 3; and second auxiliary thread 31.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Figure 2:
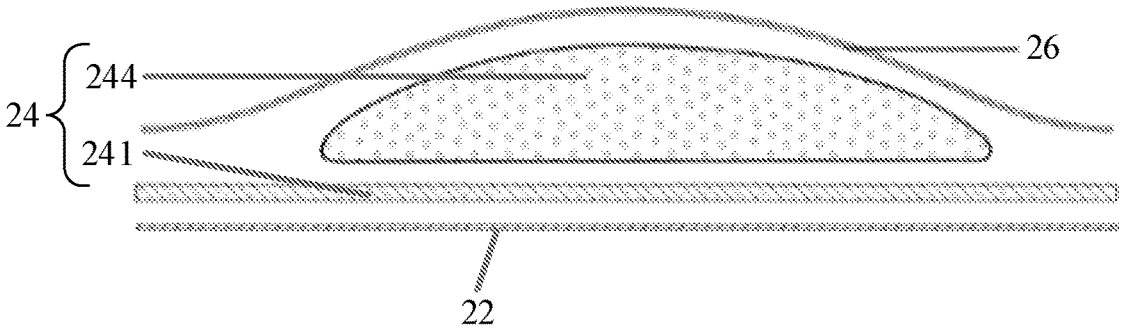
FIG. 2 is a partial cross-sectional schematic diagram of a second bulge of the cycling pad of the present disclosure.

The embodiments of the present disclosure provide a cycling pad. As shown in FIGS. 1 and 2, FIG. 1 is a schematic diagram of a first embodiment of a cycling pad of the present disclosure and FIG. 2 is a partial cross-sectional schematic diagram of a second bulge of the cycling pad of the present disclosure. The cycling pad 2 comprises a base 22, a first bulge 242, two second bulges 244, and two third bulges 246. The base 22 comprises a first end portion 222 and a second end portion 224 arranged opposite to the first end portion 222. A size of the first end portion 222 is less than a size of the second end portion 224. The first end portion 222 of the base 22 is understood as a front end of the base 22, and is a front end of the cycling pad 2. The second end 224 is understood as a rear end of the base 22, and is a rear end of the cycling pad 2. The base 22 may be in a shape of a butterfly wing, having a small end (i.e., the first end portion 222) and a large end (i.e., the second end portion 224).

The first bulge 242 is arranged on the base 22 and is arranged on the first end portion 222 of the base 22. The two second bulges 224 are arranged on the base 22 and are arranged side by side. The two second bulges 224 are arranged adjacent to one side, facing the second end portion 224 of the base 22, of the first bulge 242. The two third bulges 246 are arranged on the base 22 and are arranged side by side. The two third bulges 246 are arranged adjacent to one side, facing the second end portion 224 of base 22, of the second bulges 244.

The first bulge 242 is arranged on the first end portion 222 of the base 22. The size of the first end portion is less than the size of the second end portion of the base. The two second bulges 244 are arranged side by side and are arranged adjacent to one side, away from the first end portion 222 of the base 22, of the first bulge 242. The two third bulges 246 are arranged side by side and are arranged adjacent to one side, away from the first end portion 222 of the base 22, of the second bulges 244. The five bulges are distributed in a five-point pattern, which mitigates stress on stress-bearing portions of buttocks of a female user, such as perineum, pubis, and ischium, protects main stress-bearing portions of the buttocks of the female user, and makes the main stress-bearing portions of the buttocks of the female user evenly stressed. The cycling pad 2 is in line with a physiological structure of females and fits a body of the female user. During riding, the bulges with the five-point pattern provide a sufficient cushioning effect for the main stress-bearing portions of the buttocks of the female user. In the embodiment, the first bulge 242 corresponds to the perineum, the two second bulges 244 correspond to the pubis, and the two third bulges 246 correspond to the ischium.

The two second bulges 244 are arranged at intervals. A first groove 243 is formed between the two second bulges 244. The two third bulges 246 are arranged at intervals. A second groove 245 is formed between the two third bulges 246. The second groove 245 is communicated with the first groove 243. The first bulge 242 directly faces the first groove 243. It is understood that the first bulge 242, the two second bulges 244, and the two third bulges 246 form a three-segment V-shaped structure, so a support of the cycling pad is more precise than a conventional cycling pad, which solves a problem of pressure diffusion when the ischium (during sitting-type riding) and the pubis (during semi-lying riding) are stressed during cycling, so that blood flows through a whole body without being squeezed, which reduces a risk of numbness in a crotch and legs of the female user. Moreover, the first grooves 243 provided between the two second bulges 244 is communicated with the second grooves 245 provided between the two third bulges 246, so that a ventilation passage is formed between the buttocks of the female user and the base 22, which improves air permeability for the buttock of the female user.

The first bulge 242, each of the second bulges 244, and each of the third bulges 246 are of a gentle slope structure. It is understood that a highest point and a lowest point of the first bulge 242, a highest point and a lowest point of each of the second bulges 244 and a highest point and a lowest point of each of the third bulges 246 are transited through a respective smooth curved surface. The cycling pad 2 adopts a split hill concept, which is also understood as a unique 3D hill gentle slope design. The highest point of each of the five bulges and a portion of the curved surface surrounding and connecting the highest point fit a human body, thereby making the cycling pad 2 fit the human body.

Moreover, because each of the bulges is the gentle slope structure, after the cycling pad 2 is fitted to the human body, a highest portion of each of the bulges is squeezed and transited into a lowest portion of each of the bulges and the first groove or the second groove outside each of the bulges, so that a rear portion of the cycling pad is smooth and has a good curve. After the female user puts on the cycling pants with the cycling pad, a shape of the rear portion of the cycling pad matches a shape of the body of the female user, and there are no obvious convex blocks or depressions. Furthermore, even after the cycling pad 2 is pressed by the female user, there is still a gap between the highest point and the lowest point of each of the bulges, which enhances air permeability of the cycling pad 2.

The cycling pad 2 further comprises a buffer layer 24 and a fabric layer 26. The buffer layer 24 is arranged between the base 22 and the fabric layer 26. The buffer layer 24 comprises a plurality of buffer blocks forming the first bulge 242, the two second bulges 244, and the two third bulges 246.

Exemplarily, the cycling pad 2 adopts a three-layer composite structure. Specifically, the fabric layer 26, the buffer layer 24, and the base 22 are arranged in sequence. The fabric layer 26 may be made of skin-friendly materials. For example, a material of the fabric layer 26 may be a skin-friendly brushed fabric, having 85% polyester and 15% spandex, which is cool to touch. A material of the buffer layer 24 may be a memory foam processed by a multi-layer thickness quilting process, or 80-density memory foam having a good rebound effect. The buffer layer 24 provides a shock absorption effect and sufficient softness. A material of the base 22 can be an anti-slip breathable base cloth. The fabric layer 26, the buffer layer 24, and the base 22 are processed to form the cycling pad 2. For example, a composite punching process after hot pressing is used to process the fabric layer 26, the buffer layer 24, and the base 22.

It is understood that the embodiment of the present disclosure does not limit the materials of the fabric layer 26, the buffer layer 24, and the base 22. The material of the fabric layer 26 may be a corresponding skin-friendly material as required, the material of the buffer layer 24 may be a corresponding shock-absorbing buffer material as required, and the base 22 may be a corresponding anti-slip breathable material as required.

In some embodiments, the buffer layer 24 further comprises a buffer piece 241. The buffer piece 241 is laid flat on the base 22. The plurality of the buffer blocks is fixedly arranged on the buffer piece 241.

That is, the buffer layer 24 comprises at least two layers, where one layer is the buffer piece 241 laid flat on the base 22 and basically covers the entire base 22, and the other layer is the buffer blocks (such as the first bulge, the second bulges, and the third bulges) stacked on the base 22, which provides a cushioning effect for all portions of the female user in contact with the cycling pad, and further provides the sufficient cushioning effect for the main stress-bearing portions. In some other embodiments, the buffer layer 24 may only comprise parts of a buffer structure, such as the five bulges (the first bulge 242, the second bulges 244, and the third bulges 246).

The buffer piece 241 may be a first sponge, having a first thickness (e.g., 3 mm), and the buffer blocks (e.g., the first bulge 242, the second bulges 244, and the third bulges 246) may be second sponges, having a second thickness (e.g., 10 mm). Exemplarily, a sponge surface of a second composite fabric, having a thickness of 10 mm, and a sponge surface of a first composite fabric, having a thickness of 3 mm, are superimposed and aligned, and then the second composite fabric and the first composite fabric are put into a hot-pressing machine and are processed by a high temperature and high-pressure process to obtain a multi-layer composite sponge (i.e., the buffer layer 24).

A manufacturing method of the buffer layer 24 comprises steps: obtaining the first sponge having the thickness of 3 mm and the second sponges having the thickness of 10 mm; placing the second sponges, having the thickness of 10 mm, and a base fabric into the hot pressing machine; placing the first sponge, having the thickness of 3 mm (the first sponge has performed a punching treatment), and a shell fabric into the hot pressing machine; obtaining two composite fabrics, having different thicknesses, under a high temperature and high pressure process; overlapping and aligning the sponge surface of the first composite fabric, having a smaller thickness (that is, with respect to the first sponge having the thickness of 3 mm), with a sponge surface of a second composite fabric, having a larger thickness (that is, with respect to the second sponges having the thickness of 10 mm); and putting the two composite fabrics into the hot pressing machine and processing the two composite fabrics by the high temperature and high pressure process to obtain a multi-layer composite sponge (i.e., the buffer layer 24).

In steps of obtaining the first sponge, having the thickness of 3 mm, and the second sponges, having the thickness of 10 mm, the first sponge and the second sponges, having different thicknesses, are obtained by direct purchase. Optionally, a sponge cutting machine program is predetermined, sponges are put into a sponge cutting machine, and the sponges are cut into the first sponge, having the thickness of 3 mm, and the second sponges, having the thickness of 10 mm.

Optionally, two side edges 226 of the base 22 are arc-shaped.

Figure 3:
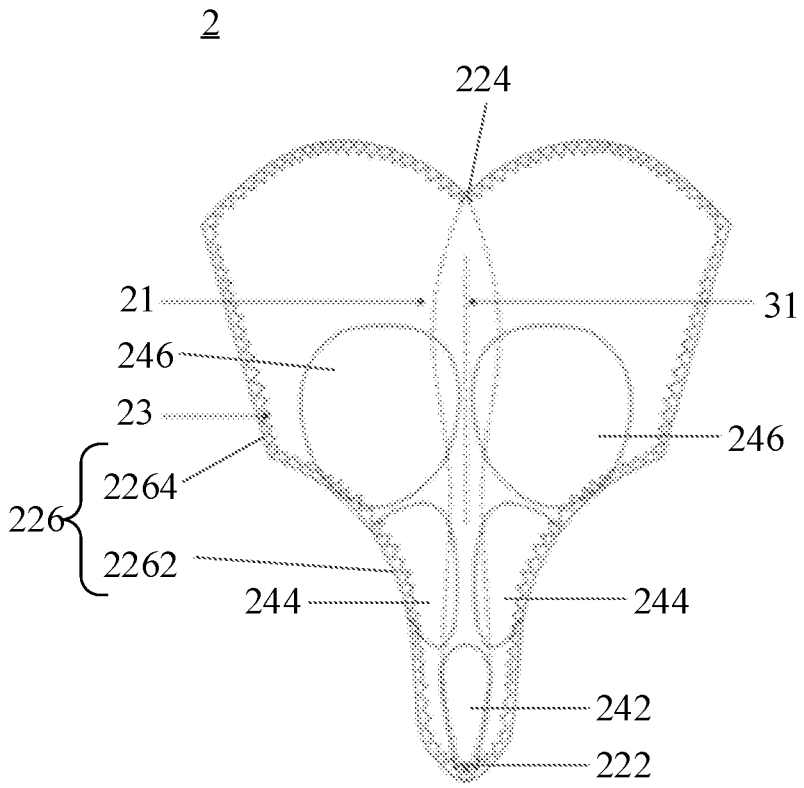
FIG. 3 is a schematic diagram of a second embodiment of the cycling pad of the present disclosure.

As shown in FIG. 3, FIG. 3 is a schematic diagram of a second embodiment of the cycling pad of the present disclosure. A main difference between the cycling pad in the embodiment and the cycling pad of the above-mentioned embodiments lies in the side edges of the cycling pad. Specifically, the base 22 comprises two side edges 226 connecting the first end portion 222 and the second end portion 224 of the base 22. The two side edges 226 of the base 22 are arranged opposite to each other. Each of the two side edges 226 comprises a first portion 2262 and a second portion 2264 connected to the first portion 2262. The first portion 2262 of each of the two side edges 226 of the base 22 is connected to the first end portion 222 of the base 22. The second portion 2264 of each of the two side edges 226 of the base 22 is connected to the second end portion 224 of the base 22. The first portion 2262 of each of the two side edges 226 of the base is a recessed curved surface, and the second portion 2264 of each of the side edges 226 of the base 22 is a flat surface.

Two sides of a portion, where the base 22 is connected to the second end portion 224 (i.e., the second portions 2264), form the flat surfaces (a cross section thereof along a thickness direction is a straight thread), and two sides of another portion, where the base 22 is connected with the first end portion 222 (i.e., the first portions 2262), form the recessed curved surfaces (a cross section thereof along the thickness direction is an arc groove). The cycling pad 2 is formed as a whole with a shovel-shaped structure symmetrical on left and right sides, which adapts to inner thighs of the human body, reduces friction on the inner thighs, and improves a comfort level, air permeability, and lifting effects on buttocks of users.

Figure 4:
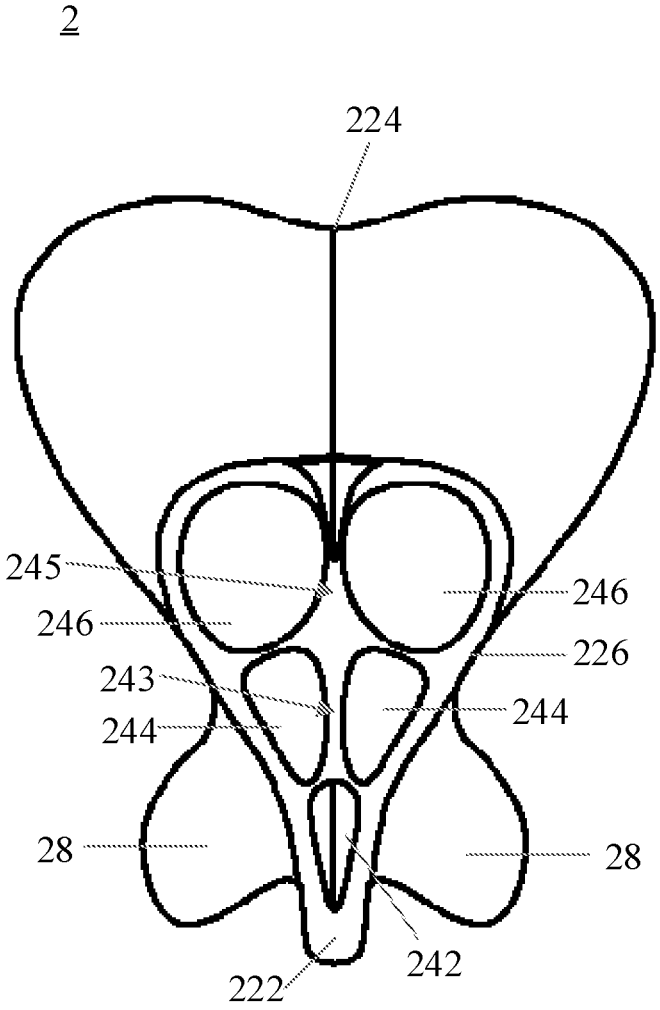
FIG. 4 is a schematic diagram of a third embodiment of the cycling pad of the present disclosure.

As shown in FIG. 4, FIG. 4 is a schematic diagram of a third embodiment of the cycling pad of the present disclosure. A main difference between the cycling pad in the embodiment and the cycling pad of the above-mentioned embodiments is the side pads of the cycling pad. Specifically, in the embodiment, the cycling pad 2 further comprises two side pads 28. The two side pads 28 are arranged on two sides of the base 22. Each of the side pads 28 is connected to a corresponding first portion 2262 of the base 22. The side pads 28 extended from the base reduce the friction on the inner thighs during riding. A shape of the side pads 28 can be set as required.

It should be noted that besides differences in physiological structures of males and the females, a pelvis width of the females is greater than stress-bearing portions of the males, and a pelvis distribution width of the females is also greater than that of the male. Thereby, a test of the cycling pad for different female users, and a test of the cycling pad in different scenarios for the female user are performed. For example, riding tests on public bikes and mountain bikes are respectively performed, and data collection is performed on a pressure and stress-bearing area of the cycling pad for different females during a riding process by an array pressure bar sensor. In the embodiment, the main stress-bearing portions of the female user when riding are obtained by combining pressure data and stress-bearing data obtained through the tests with the physiological structure of the females, and the buffer layer of the cycling pad of the embodiment is thickened according to the main stress-bearing points of the female user when riding. For example, five bulges are arranged to buffer the pressure on the main stress-bearing points of the female user, such as the perineum, the pubis, and the ischium.

Therefore, in the embodiment, according to the collected data, sponges, having a density of 0.8-1.2 g/cm$^3$, are selected to provide the shock absorption effect and sufficient softness. Due to the differences in the physiological structures of the males and the females, and according to an analysis of a stress-bearing area of the females during riding, partial areas of the buffer layer corresponding to high stress-bearing portions of the female user during the riding process are thickened. Other partial areas of the buffer layer corresponding to low stress-bearing portions of the female user are thinned. A thickest point of the cycling pad, having a thickness of 11 mm, is smoothly transited to a thinnest point of the cycling pad, having a thickness of 2 mm, which designs a G1-G2 surface to make a transition surface smooth and to be uniform and rounded in appearance.

In order to make stress on the cycling pad uniform and to strengthen an overall concept of the cycling pad, a tail portion of the cycling pad is lengthened and widened, which makes the appearance more uniform. In order to adapt to a variety of styles and facilitate cutting, a tail portion and two wings of a cycling pad production mold are lengthened and widened.

The cycling pad adopts the unique 3D hill gentle slope design, and incorporates 3D cutting technology to cut off excess portions of a front end of the conventional cycling pad. With the shock-absorbing sponge, the 3D hill gentle slope design of the cycling pad provides the sufficient cushioning effect for the perineum, the pubis, and the ischium during the riding process, which truly breaks convention and solves a series of problems such as bacterial infection in private parts of the female user, bulging in the private parts, embarrassing line, camel toe, monkey-butt look, etc. Further, the cycling pad visually optimizes a buttock shape of the female user. Furthermore, the cycling pad adopts an external and detachable design, which maximally protects the private parts of the female user. The cycling pad is breathable and fits the body of the female user, which reduces a friction problem on the private parts, existing in the conventional built-in cycling pad.

In addition, the cycling pad can be arranged in a pants body to form cycling pants. Correspondingly, the cycling pad has no side pads according to a style of the pants body of the cycling pants. When the cycling pants are made by a knife model, no side pads are required.

Figure 5:
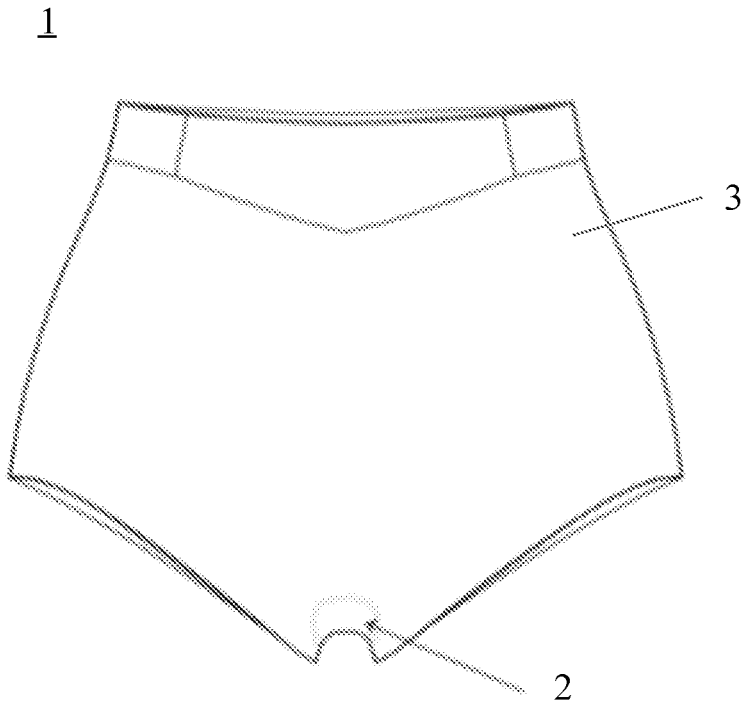
FIG. 5 is a schematic diagram of cycling pants according to one embodiment of the present disclosure.
Figure 6:
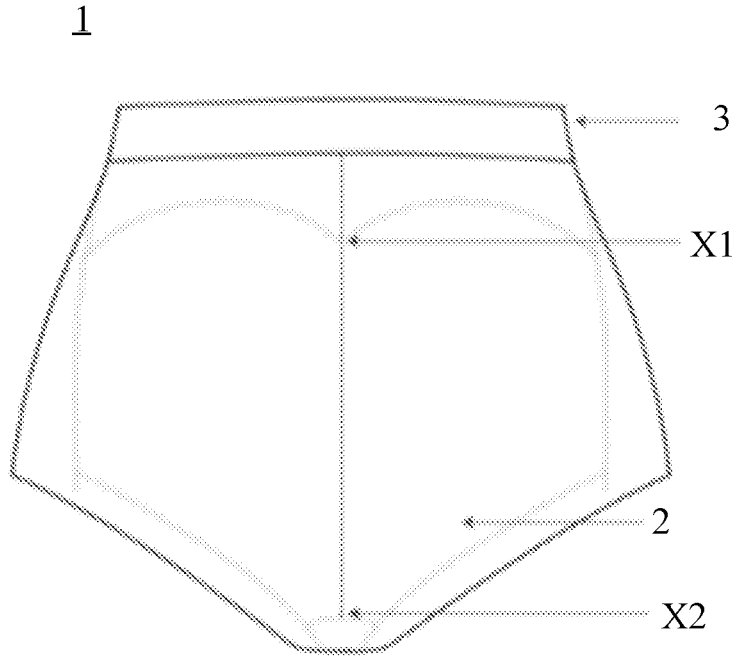
FIG. 6 is another schematic diagram of the cycling pants shown in FIG. 5.

The embodiments of the present disclosure further provide cycling pants. As shown in FIGS. 5 and 6, FIG. 5 is a schematic diagram of cycling pants according to one embodiment of the present disclosure, and FIG. 6 is another schematic diagram of the cycling pants shown in FIG. 5. The cycling pants comprise a pants body 3 and the cycling pad 2. The cycling pad 2 is mounted on the pants body 3. The cycling pad 2 may be the cycling pad 2 in any one of the above embodiments, and the structure of the cycling pad 2 will not be repeated herein.

As shown in FIGS. 1-4, the pants body 3 is selected from briefs, boxer pants or trousers. If the pants body 3 is the briefs, the pants body 3 comprises the cycling pad 2 without the side pads 28. If the pants body 3 is the boxer pants or the trousers, the pants body 3 may comprise the cycling pad 2 with the side pads 28 or the cycling pad 2 without the side pads 28.

In some embodiments, the cycling pad 2 is sewn on an inner side of a crotch portion of the pants body 3, and one side of the cycling pad 2 away from the crotch portion of the cycling pants 1 is defined as a front side, and one side that fits the crotch portion of the cycling pants 1 is defined as a rear side. The first end portion 222 of the base 22 is located on the front side of the pants body 3, and the second end portion 224 of the base 22 is located on the rear side of the pants body 3.

In some embodiments, the cycling pad 2 comprises the base 22, the first bulge 242, the two second bulges 244, and the two third bulges 246. The base 22 comprises the first end portion 222 and the second end portion 224 arranged opposite to the first end portion 222. The size of the first end portion 222 is less than the size of the second end portion 224. The first bulge 242 is arranged on the base 22 and is arranged on the first end portion 222 of the base 22. The two second bulges 224 are arranged on the base 22 and are arranged side by side. The two second bulges 224 are arranged adjacent to one side, facing the second end portion 224 of the base 22, of the first bulge 242. The two third bulges 246 are arranged on the base 22 and are arranged side by side. The two third bulges 246 are arranged adjacent to one side, facing the second end portion 224 of the base 22, of the second bulges 244.

In some embodiments, the two second bulges 244 are arranged at intervals. The first groove 243 is formed between the two second bulges 244. The two third bulges 246 are arranged at intervals. The second groove 246 is formed between the two third bulges 246. The second groove 245 is communicated with the first groove 243. The first bulge 242 faces the first groove 243.

In some embodiments, the first bulge 242, each of the second bulges 244, and each of the third bulges 246 are of the gentle slope structure.

In some embodiments, the base 22 comprises the two side edges 226 connecting the first end portion 222 and the second end portion 224 of the base 22. The two side edges 226 of the base 22 are arranged opposite to each other. Each of the two side edges 226 comprises a first portion 2262 and a second portion 2264 connected to the first portion 2262. The first portion 2262 of each of the two side edges 226 of the base 22 is connected to the first end portion 222 of the base 22. The second portion 2264 of each of the two side edges 226 of the base 22 is connected to the second end portion 224 of the base 22. The first portion 2262 of each of the two side edges 226 of the base is a recessed curved surface and the second portion 2264 of each of the two side edges 226 of the base 22 is a flat surface.

Figure 7:
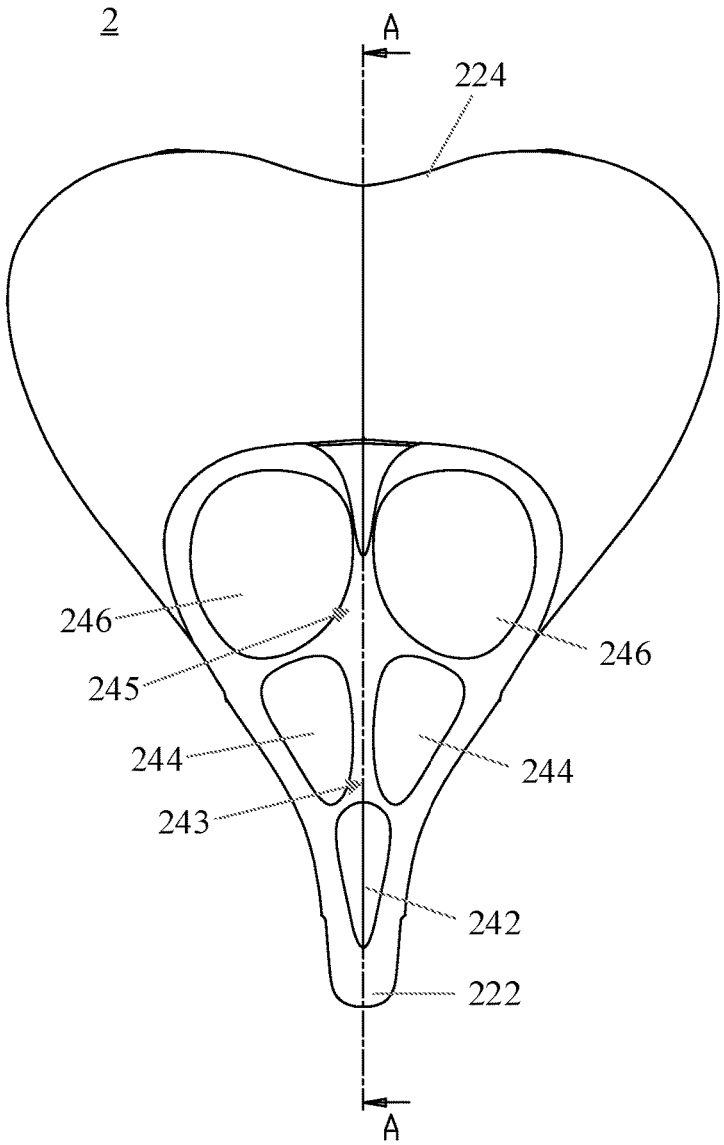
FIG. 7 is a schematic diagram of the cycling pad in the cycling pants shown in FIG. 5.
Figure 8:
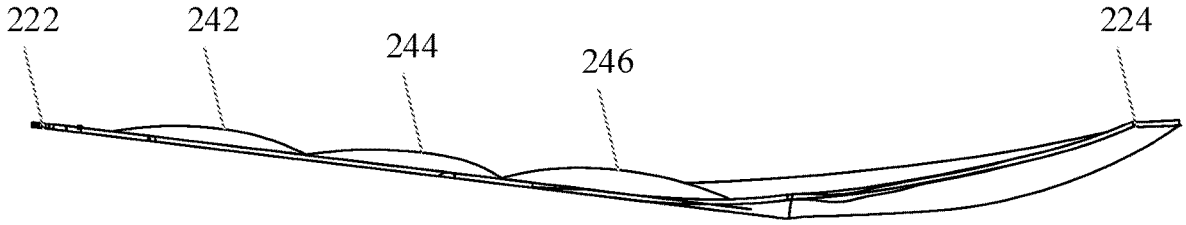
FIG. 8 is a cross-sectional view of the cycling pad taken along the line A-A shown in FIG. 7.

In some embodiments, as shown in FIGS. 7 and 8, FIG. 7 is a schematic diagram of the cycling pad in the cycling pants shown in FIG. 5, and FIG. 8 is a cross-sectional view of the cycling pad taken along the line A-A shown in FIG. 7. An edge of the cycling pad 2 is fixedly connected to the pants body 3, and a middle portion of the cycling pad 2 away from the pants body defines a bulge, so that there is a gap between the cycling pad 2 and the pants body 3, which provides a ventilation channel and improves ventilation.

In some optional embodiments, the bulge extends from the first end portion 222 to the second end portion 224 of the cycling pad 2. That is, the ventilation channel runs through the cycling pad 2, and the ventilation channel is not easily blocked, which is conducive to ventilation and heat dissipation, reduces a feeling of stuffiness, and improves the comfort level.

Optionally, the cycling pad 2 may be mounted on an inner side of the pants body 3, or may be mounted on an outer side of the pants body 3.

Most of the conventional built-in cycling pads are designed to protect the physiological structure of the males, and most of the conventional built-in cycling pads are sewn in the crotch portion of the cycling pants. A bottom portion of the cycling pants is in a form of a triangular crotch portion or one piece made by direct cutting, and the structure does not 100% fit of the bodies of the females. For the females, during a wearing process, foreign body sensation in the crotch is serious, which affects walking. During the riding process, a front end of a seat causes a certain degree of pressure and friction to soft tissues of the private parts of the females. The conventional built-in cycling pads are in contact with the private parts of the females for a long time, which causes various discomforts in the crotch, and further makes the private parts of the females in a stuffy, humid, and impermeable environment. Therefore, the private parts of the females are easy to breed bacteria and cause inflammation of the private parts such as vaginitis, peritonitis, etc., which seriously affect health of the females.

In the cycling pants, the cycling pad adopts the unique 3D hill gentle slope design, which provides enough cushioning effect for the buttocks of the users, eliminates embarrassment of the users about monkey-butt look in appearance, and truly breaks the convention (cycling pants are mostly designed for the males).

The cycling pad incorporates 3D cutting technology and the excess portions of the front end of the conventional cycling pad are cut off in the cycling pad. With the shock-absorbing sponge, the cycling pad provides the sufficient cushioning effect for the buttocks of the users. The cycling pad adopts the external and detachable design, which maximally protects the private parts of the female user. The cycling pad is breathable and fits the bodies of the females, which reduces the friction problem on the private parts, existing in the conventional built-in cycling pads, and truly breaks the convention and solves a series of problems such as the bacterial infection in the private parts of the female user, the bulging in the private parts, the embarrassing line, the camel toe, the monkey-butt look, etc. Further, the cycling pad visually optimizes the buttock shape of the female user.

From three dimensions of ergonomics, user psychology, and fashion design of clothing, aiming at the physiological structure of the females, the cycling pants 1 with the cycling pad arranged outside propose a concept of innovative wearing methods and provide a new concept of wearing protective clothing.

In the embodiment, the cycling pad 2 is seamlessly fitted with the human body through an advanced garment draping technique, which reduces wind resistance and improves a riding speed. Moreover, the cycling pants wrap leg muscles, buttock muscles (such as quadriceps, gluteus maximus, hamstrings on thighs, and soleus and gastrocnemius on the calves) 360 degrees during exercise. Tight wrapping of the cycling pants 1 greatly reduces energy lost due to muscle tremors during cycling, maintains good physical strength, and further makes legs better pressurized by the cycling pants, which increases a blood speed and delivers more oxygen and glucose to the muscles for promoting decomposition of lactic acid. Therefore, muscle pain during exercise is reduced, a riding comfort level is improved, physical recovery ability of riders is improved, and the probability of physical injury caused by exercise is greatly reduced or eliminated.

The cycling pad adopts the external and detachable design, which maximally protects the private parts of the female user. The cycling pad is breathable and fitted, which reduces the friction problem on the private parts, existing in the conventional built-in cycling pads.

Figure 9:
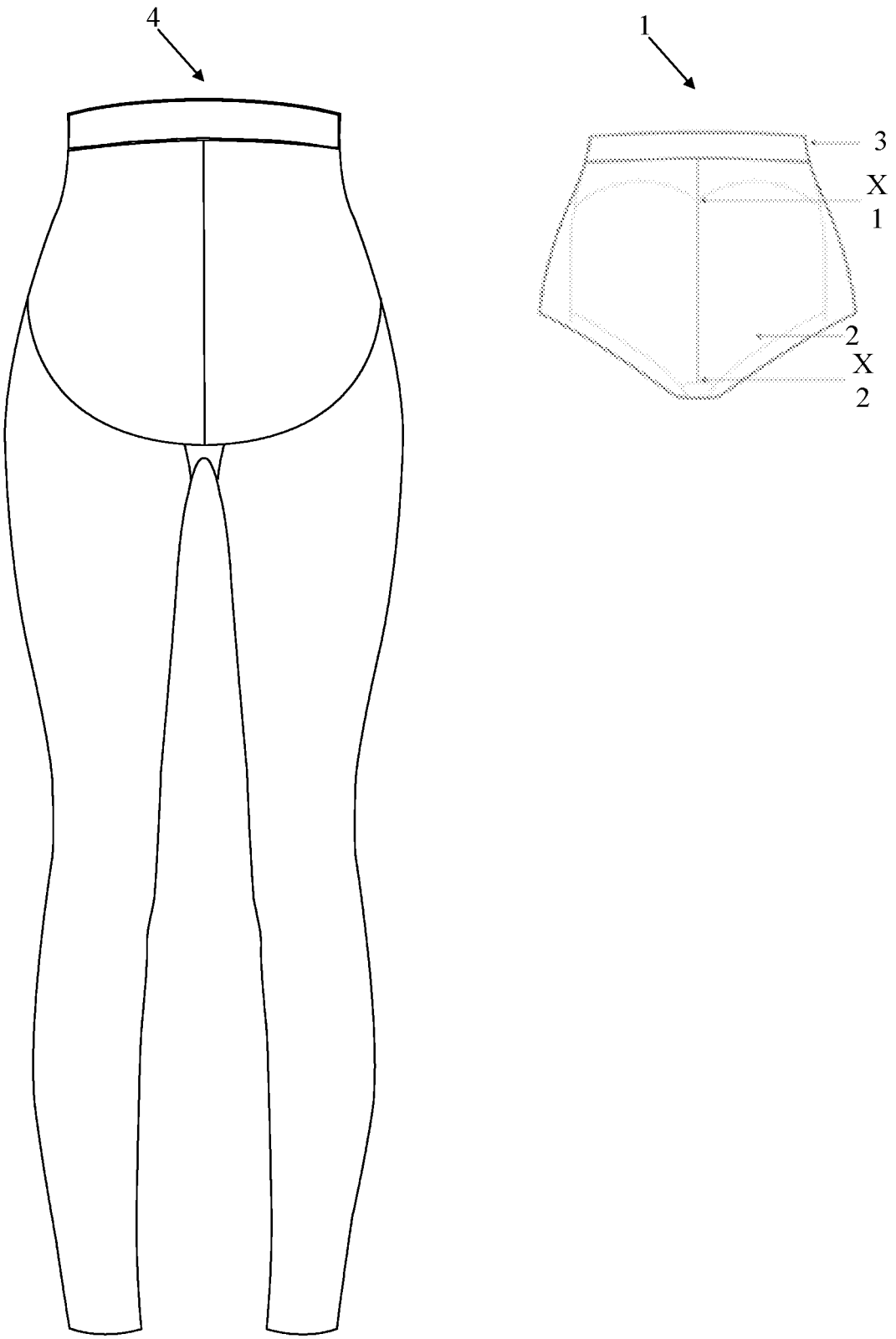
FIG. 9 is a schematic diagram of the cycling pants and a first pants body according to one embodiment of the present disclosure.

Based on characteristics of the physiological structure of the females, the private parts of the females have extremely high requirements for hygiene, quality, and safety. The present disclosure innovatively proposes a concept of the cycling pants 1 externally arranged with the cycling pad 2, and the use of the cycling pants 1, by externally arranging with the cycling pad 2, physically isolates the private parts, susceptible to bacteria. Specifically, as shown in FIG. 9, FIG. 9 is a schematic diagram of the cycling pants and a first pants body according to one embodiment of the present disclosure. The cycling pants in the embodiment are configured as cycling pants of the users, which can be worn outside. After the users put on the first pants body 4, the users put on the cycling pants 1. When the users have no need to ride or the users are in other scenarios, the users may conveniently take off the cycling pants 1 worn outside and put on the first pants body 4 for normal activities.

The cycling pants 1 worn outside may be freely put on and taken off according to riding needs, which solves a problem of scene limitation of integrated cycling pants 1 with the cycling pad. The riders can take off the cycling pants 1 with the cycling pad during cycling rest for physical ventilation and quick-drying. Furthermore, it is convenient for the riders to enter other leisure scenes to rest on the way, which solves an embarrassing problem of embarrassing bulges in the conventional cycling pants. The cycling pad adopts the external and detachable design, which maximally protects the private parts of the female user. The cycling pad is breathable and fits the female body, which reduces the friction problem on the private parts, existing in the conventional built-in cycling pads. The cycling pants that can be put on or taken off freely redefine scene experience of professional cycling pants of the females, so that the professional cycling pants of the females are applied to daily life scenes. The users can select the corresponding first pants body as required. For example, the first pants body 4 may be a pants body matched with the cycling pants 1, and the first pants body 4 may be other pants bodies, which is not limited thereto. Of course, in some other embodiments, the cycling pants 1 are configured as integrated cycling pants 1. That is, the users are unable to take off the cycling pants 1 at will when being in public places. For example, after the users take off the cycling pants 1, the users need to put on another pair of pants for free movement.

Figure 10:
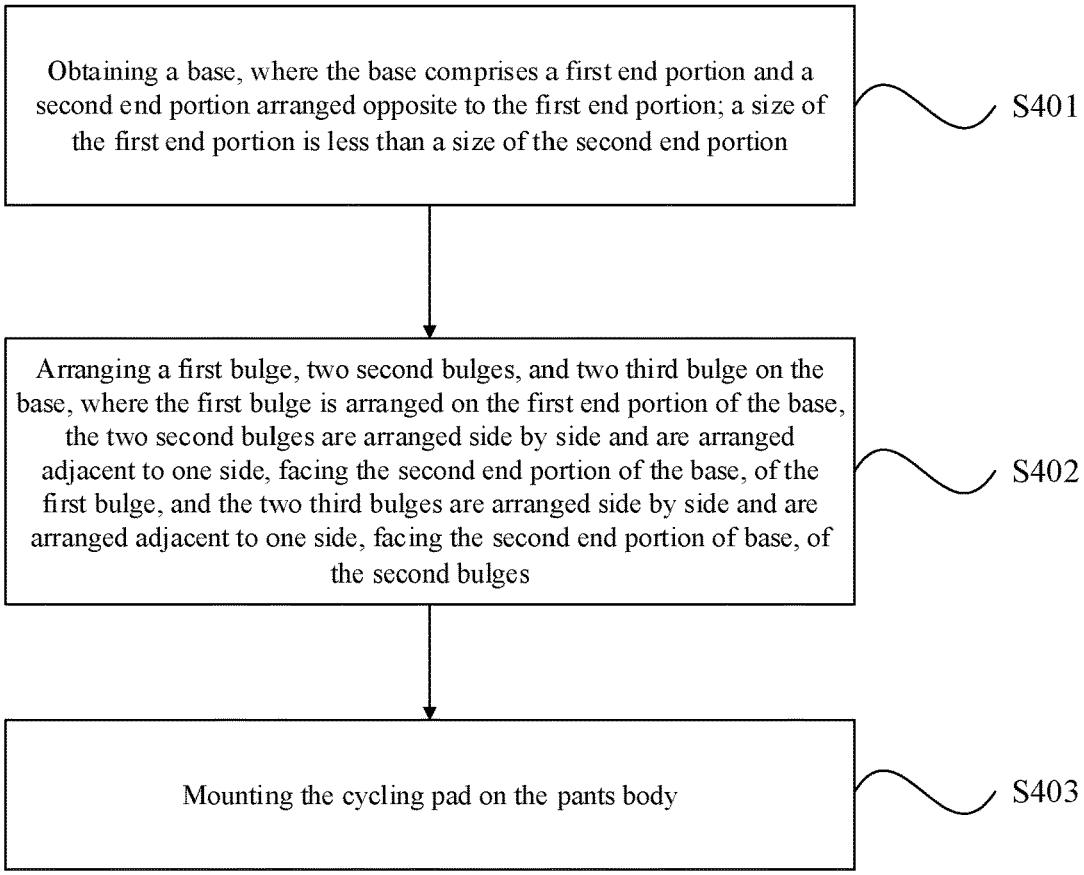
FIG. 10 is a flow chart of a manufacturing method of cycling pants according to one embodiment of the present disclosure.

The embodiments of the present disclosure further provide a manufacturing method of cycling pants. As shown in FIG. 10, FIG. 10 is a flow chart of a manufacturing method of cycling pants according to one embodiment of the present disclosure. As shown in FIGS. 1-8, the manufacturing method comprises steps:

S401: obtaining a base 22, where the base 22 comprises a first end portion 222 and a second end portion 224 arranged opposite to the first end portion 222, and a size of the first end portion 222 is less than a size of the second end portion 224;

S402: arranging a first bulge 242, two second bulges 244, and two third bulge 246 on the base 22, where the first bulge 242 is arranged on the first end portion 222 of the base 22, the two second bulges 244 are arranged side by side and are arranged adjacent to one side, facing the second end portion 224 of the base 22, of the first bulge 242, and the two third bulges 246 are arranged side by side and are arranged adjacent to one side, facing the second end portion 224 of the base 22, of the second bulges 224.

S403: mounting the cycling pad 2 on the pants body 3.

In the S401, the first end portion 222 of the base 22 is understood as a front end of the base 22, and is a front end of the cycling pad 2. The second end 224 is understood as a rear end of the base 22, and is a rear end of the cycling pad 2. The base 22 may be in a shape of a butterfly wing, having a small end (i.e., the first end portion 222) and a large end (i.e., the second end portion 224).

In the S402, the first bulge 242 is arranged on the first end portion 222 of the base 22. The size of the first end portion is less than the size of the second end portion of the base. The two second bulges 244 are arranged side by side and are arranged adjacent to one side, away from the first end portion 222 of the base 22, of the first bulge 242. The two third bulges 246 are arranged side by side and are arranged adjacent to one side, away from the first end portion 222 of the base 22, of the second bulges 244. The five bulges are distributed in a five-point pattern, which mitigates the stress on the stress-bearing portions of buttocks of the female user, such as the perineum, the pubis, and the ischium, protects the main stress-bearing portions of the female user, and makes the main stress-bearing portions of the female user evenly stressed. The cycling pad 2 is in line with the physiological structure of women and fits the body of the female user. During riding, the bulges with the five-point pattern provide the sufficient cushioning effect for the main stress-bearing portions of the buttock of the female user.

The manufacturing method of the cycling pants further comprises other steps.

In one embodiment, the two second bulges 244 are arranged at intervals. A first groove 243 is formed between the two second bulges 244. The two third bulges 246 are arranged at intervals. A second groove 246 is formed between the two third bulges 246. The second groove 245 is communicated with the first groove 243. The first bulge 242 faces the first groove 243. It is understood that first bulge 242, the two second bulges 244, and the two third bulges 246 form a three-segment V-shaped structure, so the support of the cycling pad is more precise than the conventional cycling pad. It solves the problem of pressure diffusion when the ischium (during sitting-type riding) and the pubis (during-semi-lying riding) are stressed during cycling, so that the blood flows through the whole body without being squeezed, which reduces the risk of numbness in the crotch and legs of the female user. Moreover, the first grooves 243 provided between the two second bulges 244 is communicated with the second grooves 245 provided between the two third bulges 246, so that a ventilation passage is formed between the buttock of the female user and the base 22, which improves the ventilation for the buttock of the female user.

In another embodiment, the first bulge 242, each of the second bulges 244, and each of the third bulges 246 are of a gentle slope structure. It is understood that a highest point and a lowest point of the first bulge 242, a highest point and a lowest point of each of the second bulges 244 and a highest point and a lowest point of each of the third bulges 246 are transited through a respective smooth curved line.

In another embodiment, the cycling pad 2 adopts a three-layer composite structure. Specifically, the fabric layer 26, the buffer layer 24, and the base 22 are arranged in sequence. For example, a composite punching process after hot pressing is used to process the fabric layer 26, the buffer layer 24, and the base 22. For the materials of the fabric layer 26, the buffer layer 24, and the base 22, reference may be made to the above-mentioned embodiments, which will not be repeated herein.

In another embodiment, a manufacturing method of the buffer layer 24 comprises steps: obtaining a first sponge, having a thickness of 3 mm, and second sponges, having a thickness of 10 mm; placing the second sponges, having the thickness of 10 mm, and a base fabric into the hot pressing machine; placing the first sponge, having the thickness of 3 mm (the first sponge has performed a punching treatment), and a shell fabric into the hot pressing machine; obtaining two composite fabrics, having different thicknesses, under a high temperature and high pressure process; overlapping and aligning a sponge surface of a first composite fabric, having a smaller thickness (that is, with respect to the first sponge having the thickness of 3 mm), and a second composite fabric, having a larger thickness (that is, with respect to the second sponges having the thickness of 10 mm); and putting the two composite fabrics into the hot pressing machine and processing by the high temperature and high pressure process to obtain a multi-layer composite sponge (i.e., the buffer layer 24). For the specific structure of the buffer layer 24, reference may be made to the above-mentioned embodiments, which is not repeated herein.

In the S403, the cycling pad 2 may be mounted on the inner side of the pants body 3, or the cycling pad 2 may be mounted on the outer side of the pants body 3.

In some embodiments, a step of mounting the cycling pad 2 on the pants body 3 comprises:

obtaining the cycling pad 2, bulging a middle portion of the cycling pad 2; and fixing an edge of the cycling pad 2 on the pants body 3.

The bulge in the middle portion of the cycling pad 2 forms a certain space for air circulation with the pants body 3, which is conducive to ventilation and heat dissipation, reduces the feeling of stuffiness, and improves comfort.

Figure 11:
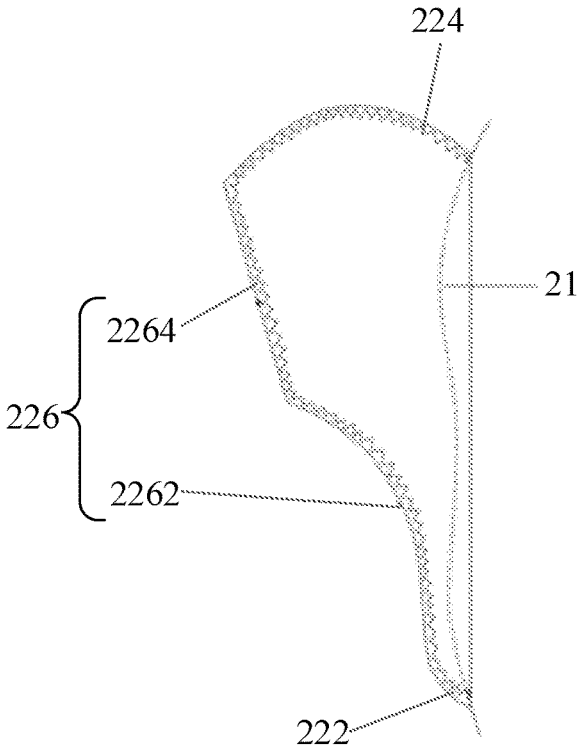
FIG. 11 is a schematic diagram of the cycling pad according to one embodiment of the present disclosure where the cycling pad is half-folded.

In some embodiments, as shown in FIG. 11, FIG. 11 is a schematic diagram of the cycling pad according to one embodiment of the present disclosure where the cycling pad is half-folded. A step of bulging the middle portion of the cycling pad comprises:

folding the cycling pad 2 in half along a center line of the cycling pad;

sewing a first auxiliary thread 21 on the cycling pad 2 that is half-folded with respect to the center line to fix overlapping sides of the cycling pad 2 together;

obtaining a pants body 3, and aligning the cycling pad 2 with the pants body 3;

unfolding the cycling pad 2 that is half-folded, so that the middle portion of the cycling pad sewn by the first auxiliary thread 21 is raised to define a bulge;

fixing an edge of the cycling pad 2, having the bulge raised on the middle portion, on the pants body 3; and removing the first auxiliary thread 21 of the cycling pad 2.

The cycling pad 2 is folded in half along the center line, and then the first auxiliary thread 21 is sewn, which ensures that a fixing portion of the first auxiliary thread 21 is the middle portion of the cycling pad 2. The cycling pad 2 has a three-dimensional effect, having the bulge in the middle portion, forming a perfect pants shape that fits the curve of the human body, which is comfortable to wear and protects muscles. The bulge in the middle portion of the cycling pad 2 forms a certain space for air circulation with the pants body 3, which is conducive to ventilation and heat dissipation, reduces the feeling of stuffiness, and improves comfort.

In some embodiments, the first auxiliary thread is curved away from the center line at the front portion and the rear portion of the cycling pad. The first auxiliary thread is curved toward the center line in the middle portion of the cycling pad.

The first auxiliary thread 21 is curved so that a center of the cycling pad 2 is easily aligned with a center of a corresponding sewing position on the pants body 3, and the cycling pad 2 is positioned accurately and symmetrically.

In some embodiments, in a step of sewing the first auxiliary thread on the cycling pad that is half-folded with respect to the center line to fix the overlapping sides of the cycling pad together, the first auxiliary thread is not knotted.

A step of removing the first auxiliary thread of the cycling pad comprises holding one end of the first auxiliary thread and withdrawing the first auxiliary thread to remove the first auxiliary thread.

The first auxiliary thread 21 is designed to be detachable, and after the cycling pants are made, the first auxiliary thread 21 is easily removed.

In some embodiments, after unfolding the cycling pad 2 that is half-folded, the manufacturing method further comprises a step of sewing a second auxiliary thread 31 at a position of the pants body 3 corresponding to the center line of the cycling pad 2.

After removing the first auxiliary thread of the cycling pad, the manufacturing method further comprises a step of removing the second auxiliary thread 31 of the pants body 3.

When sewing the second auxiliary thread, the second auxiliary thread 31 is a straight thread, which prevents the position of the edge of the cycling pad 2 from being inaccurate during a sewing process. Thus, sewing quality of the cycling pad 2 is improved, a repair rate is reduced, and sewing efficiency is improved.

In some embodiments, in a step of sewing the second auxiliary thread 31 at the position of the pants body 3 corresponding to the center line of the cycling pad 2, the second auxiliary thread 31 is not knotted.

A step of removing the second auxiliary thread 31 of the pants body 3 comprises holding one end of the second auxiliary thread 31 and withdrawing the second auxiliary thread 31 to remove the second auxiliary thread 31.

The second auxiliary thread 31 is designed to be detachable, and after the cycling pants are made, the second auxiliary thread 31 is easily removed.

In order to well understand the manufacturing method of the cycling pants in the embodiment, the following is an example to illustrate the manufacturing method of the cycling pants with reference to FIGS. 1-10.

Step 1: folding the cycling pad 2 in half along the center line so that symmetrical sides of the cycling pad 2 overlap with each other, and the front side of the cycling pad 2 is outside and the rear side of the cycling pad 2 is folded inside.

Step 2: sewing the first auxiliary thread 21 at a position close to the center line of the cycling pad 2; fixing the symmetrical sides of the cycling pad 2 overlapped with each other by the first auxiliary thread 21; and extending two ends of the first auxiliary thread 21 respectively from the front and rear ends of the cycling pad 2 without knotting, where the first auxiliary thread 21 is curved and adapts to a curved shape of the edge 226 of the cycling pad 2, the first auxiliary thread 21 on the front portion and the rear portion of the cycling pad 2 is curved away from the center line, and the first auxiliary thread 21 is curved closer to the center line at a connecting position of the front portion and the rear portion of the cycling pad 2.

Step 3: drawing sewing positions of the cycling pad 2 on a crotch portion of a front pants sheet and a crotch portion of a rear pants sheet of the pants body 3, where a bottom portion of the cycling pad 2 is aligned and overlapped a dividing line of the rear pants sheets of the pants body 3.

Step 4: unfolding the folded cycling pad 2 with the front side of the cycling pad facing upwards, where the middle portion of the cycling pad 2 sewn by the first auxiliary thread 21 is raised upward; finding out the center of the cycling pad 2 in the middle portion; aligning the center of the cycling pad 2 with a center of the sewing positions drawn on the front pants sheet and the rear pants sheets of the pants body 3; flattening a circumference of the cycling pad 2; sewing the second auxiliary thread 31 along a center position X1 of the rear pants sheet of the pants body 3 ~5 cm down to a position X2 up 3~5 cm, where the second auxiliary thread 31 is the straight thread without knotting; and making a circle of a herringbone thread 23 along the edge of the cycling pad 2 at a distance of 0.05 to 1.5 cm by a herringbone stitch method to fix the cycling pad 2 on the pants body 3.

Step 5: removing the first auxiliary thread 21 of the cycling pad 2, and when removing the first auxiliary thread 21, directly holding the one end of the first auxiliary thread 21 and withdrawing the first auxiliary thread 21 with stress; and removing the second auxiliary thread 31 of the pants body 3, when removing the second auxiliary thread 31, directly withdrawing the second auxiliary thread 31 by a removal tool or holding the one end of the second auxiliary thread 31 and withdrawing the second auxiliary thread 31 with force.

In the above-mentioned sewing method of the cycling pad 2, the cycling pad 2 is folded in half along the center line, and then the first auxiliary thread 21 is sewn, which ensures that the fixing portion fixed by the first auxiliary thread 21 is the middle portion of the cycling pad 2. The first auxiliary thread 21 is a curved thread, and the middle portion thereof is bent toward the center line, which is conductive to position the center of the cycling pad 2, so as to facilitate the alignment between the center of the cycling pad 2 and the center of the sewing positions drawn on the pants body 3, so that the position of the cycling pad 2 on the pants body 3 is accurate, and left and right sides of the cycling pad 2 are symmetrical.

The second auxiliary thread 31 is a straight thread, which prevents a position of the edge of the cycling pad 2 from being inaccurate during the sewing process, thereby improving the sewing quality of the cycling pad 2, reducing the repair rate, and improving the sewing efficiency. In addition, after the first auxiliary thread 21 and the second auxiliary thread 31 are removed, the cycling pad 2 has a three-dimensional effect with the bulge that is upward in the middle portion, a perfect pants shape that fits the human body curve is formed. The cycling pants are comfortable to wear and protect muscles. The bulge in the middle portion of the cycling pad 2 forms a certain space for air circulation with the pants body 3, which is conducive to ventilation and heat dissipation, reduces the sultry feeling, and improves the comfort level.

It is understood that the manufacturing method of the cycling pants in the embodiment can be used to make the cycling pants or the cycling pad in any of the above embodiments. The manufacturing method of the cycling pants in the embodiment may further comprise other steps, so as to manufacture and form the cycling pants or the cycling pad in any of the above embodiments, which is not repeated herein. Similarly, the cycling pants in the embodiment may further comprise other structures, which are formed by the manufacturing method of the cycling pants in any one of the above embodiments and are not repeated herein.

The cycling pad, the cycling pants, and their manufacturing methods provided by the embodiments of the present disclosure have been described in detail above. The principles and implementations of the present disclosure are described with specific embodiments in this paper. The descriptions of the above embodiments are only used for well understanding the method of the present disclosure and the core idea. Meanwhile, for those skilled in the art, according to the idea of the present disclosure, there will be changes in the specific implementation and application scope. In summary, the content of the specification should not be understood as a limitation of the present disclosure.

What is claimed is:

1. A cycling pad, comprising:

a base;

a first bulge;

two second bulges; and two third bulges;

wherein the base comprises a first end portion and a second end portion arranged opposite to the first end portion; a size of the first end portion is less than a size of the second end portion; the first bulge is arranged on the base and is arranged on the first end portion of the base; the two second bulges are arranged on the base and are arranged side by side; the two second bulges are arranged adjacent to one side, facing the second end portion of the base, of the first bulge; the two third bulges are arranged on the base and are arranged side by side; the two third bulges are arranged adjacent to one side, facing the second end portion of base, of the second bulges;

wherein the cycling pad further comprises a buffer layer and a fabric layer; the buffer layer is arranged between the base and the fabric layer; the buffer layer comprises a plurality of buffer blocks forming the first bulge, the two second bulges, and the two third bulges.

2. The cycling pad according to claim 1, wherein the two second bulges are arranged at intervals, a first groove is formed between the two second bulges;

the two third bulges are arranged at intervals; a second groove is formed between the two third bulges; and the second groove is communicated with the first groove, the first bulge faces the first groove.

3. The cycling pad according to claim 2, wherein the first bulge, each of the second bulges, and each of the third bulges are of a gentle slope structure.

4. The cycling pad according to claim 1, wherein the buffer layer further comprises a buffer piece; the buffer piece is laid flat on the base; the plurality of the buffer blocks is fixedly arranged on the buffer piece.

5. The cycling pad according to claim 1, wherein the base comprises two side edges connecting the first end portion and the second end portion of the base; the two side edges of the base are arranged opposite to each other; each of the two side edges comprises a first portion and a second portion connected to the first portion; the first portion of each of the two side edges of the base is connected to the first end portion of the base; the second portion of each of the two side edges of the base is connected to the second end portion of the base, the first portion of each of the two side edges of the base is a recessed curved surface; the second portion of each of the two side edges of the base is a flat surface.

6. The cycling pad according to claim 5, wherein the cycling pad further comprises two side pads; the two side pads are arranged on two sides of the base; each of the side pads is connected to a corresponding first portion of the base.

7. Cycling pants, comprising:

a pants body; and the cycling pad according to claim 1;

wherein the cycling pad is mounted on the pants body.

8. The cycling pants according to claim 7, wherein an edge of the cycling pad is fixedly connected to the pants body, and a middle portion of the cycling pad away from the pants body defines a bulge.

9. The cycling pants according to claim 8, wherein the bulge extends from the first end portion to the second end portion of the cycling pad.

10. A manufacturing method of cycling pants, comprising steps:

obtaining a base, where the base comprises a first end portion and a second end portion arranged opposite to the first end portion; a size of the first end portion is less than a size of the second end portion;

arranging a first bulge, two second bulges, and two third bulge on the base, where the first bulge is arranged on the first end portion of the base, the two second bulges are arranged side by side and are arranged adjacent to one side of the first bulge facing the second end portion of the base, and the two third bulges are arranged side by side and are arranged adjacent to one side, facing the second end portion of the base, of the second bulges; and mounting the cycling pad on the pants body;

wherein a step of mounting the cycling pad on the pants body comprises:

obtaining the cycling pad; bulging a middle portion of the cycling pad; and fixing an edge of the cycling pad on the pants body;

wherein a step of bulging the middle portion of the cycling pad comprises:

folding the cycling pad in half along a center line of the cycling pad;

sewing a first auxiliary thread on the cycling pad that is half-folded with respect to the center line to fix overlapping sides of the cycling pad together, where the first auxiliary thread is a curved thread extending from a front end to a rear end of the cycling pad;

obtaining a pants body, and aligning the cycling pad with the pants body;

unfolding the cycling pad that is half-folded so that the middle portion of the cycling pad sewn by the first auxiliary thread is raised to define a bulge;

fixing an edge of the cycling pad, having the bulge raised on the middle portion, on the pants body; and removing the first auxiliary thread of the cycling pad.

11. The manufacturing method of the cycling pants according to claim 10, wherein the first auxiliary thread is curved away from the center line at a front portion and a rear portion of the cycling pad; the first auxiliary thread is curved toward the center line in the middle portion of the cycling pad.

12. The manufacturing method of the cycling pants according to claim 10, wherein in a step of sewing the first auxiliary thread on the cycling pad that is half-folded with respect to the center line to fix the overlapping sides of the cycling pad together, the first auxiliary thread is not knotted;

wherein a step of removing the first auxiliary thread of the cycling pad comprises holding one end of the first auxiliary thread and withdrawing the first auxiliary thread to remove the first auxiliary thread.

13. The manufacturing method of the cycling pants according to claim 10, wherein after unfolding the cycling pad that is half-folded, the manufacturing method further comprises a step of sewing a second auxiliary thread at a position of the pants body corresponding to the center line of the cycling pad;

wherein after removing the first auxiliary thread of the cycling pad, the manufacturing method further comprises a step of removing the second auxiliary thread of the pants body.

14. The manufacturing method of the cycling pants according to claim 10, wherein in a step of sewing the second auxiliary thread at the position of the pants body corresponding to the center line of the cycling pad, the second auxiliary thread is not knotted;

wherein a step of removing the second auxiliary thread of the pants body comprises holding one end of the second auxiliary thread and withdrawing the second auxiliary thread to remove the second auxiliary thread.

15. A cycling pad, comprising:

a base;

a first bulge;

two second bulges; and two third bulges;

wherein the base comprises a first end portion and a second end portion arranged opposite to the first end portion; a size of the first end portion is less than a size of the second end portion; the first bulge is arranged on the base and is arranged on the first end portion of the base; the two second bulges are arranged on the base and are arranged side by side; the two second bulges are arranged adjacent to one side, facing the second end portion of the base, of the first bulge; the two third bulges are arranged on the base and are arranged side by side; the two third bulges are arranged adjacent to one side, facing the second end portion of base, of the second bulges;

wherein the base comprises two side edges connecting the first end portion and the second end portion of the base;

the two side edges of the base are arranged opposite to each other; each of the two side edges comprises a first portion and a second portion connected to the first portion; the first portion of each of the two side edges of the base is connected to the first end portion of the base; the second portion of each of the two side edges of the base is connected to the second end portion of the base, the first portion of each of the two side edges of the base is a recessed curved surface; the second portion of each of the two side edges of the base is a flat surface.

* * * * *